US006499827B2

(12) United States Patent
Elgee

(10) Patent No.: US 6,499,827 B2
(45) **Date of Patent: *Dec. 31, 2002**

(54) APPARATUS AND METHOD OF COMPENSATING FOR PRINT ENGINE AND ENCODER EXPANSION OR CONTRACTION IN A PRINTING DEVICE

(75) Inventor: Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/970,538

(22) Filed: Oct. 3, 2001

(65) Prior Publication Data

US 2002/0044169 A1 Apr. 18, 2002

Related U.S. Application Data

(63) Continuation of application No. 09/690,689, filed on Oct. 16, 2000, now Pat. No. 6,318,839.

(51) Int. Cl.[7] ..... B41J 23/00
(52) U.S. Cl. ..... 347/37
(58) Field of Search ..... 347/37, 14, 19, 347/5, 9; 341/3; 400/283, 303

(56) References Cited

U.S. PATENT DOCUMENTS

| | | | | |
|---|---|---|---|---|
| 5,605,407 A | | 2/1997 | Hama | 400/705.1 |
| 6,010,206 A | * | 1/2000 | Simons | 347/40 |
| 6,193,350 B1 | | 2/2001 | Hadley | 347/19 |
| 6,264,303 B1 | * | 7/2001 | Watanabe | 347/37 |
| 6,318,839 B1 | * | 11/2001 | Elgee | 347/37 |
| 6,331,039 B1 | * | 12/2001 | Iwasaki et al. | 347/11 |
| 6,371,593 B1 | * | 4/2002 | Li et al. | 347/19 |

FOREIGN PATENT DOCUMENTS

JP 2000355110 12/2000

* cited by examiner

*Primary Examiner*—Michael Nghiem

(57) ABSTRACT

Apparatus and method are disclosed herein that compensate for print engine and encoder expansion or contraction in a printing device. An embodiment of an apparatus in accordance with the present invention for use in a printing device having a print engine and an encoder that indicates where the print engine should print on a print medium, includes a first target on the encoder and a second target on the encoder. The apparatus also includes a first sensor configured to output a first signal upon detection of the first target and a second sensor configured to output a second signal upon detection of the second target. The apparatus additionally includes a computing device coupled to the first sensor, the second sensor and the print engine, which is configured to determine a difference between receipt of the first signal and the second signal, and to adjust when the print engine prints on the print medium based on this difference. An embodiment of a method in accordance with the present invention for use in the above-described printing device, includes measuring a difference between an amount of expansion of the print engine during printing and an amount of expansion of the encoder. The method also includes adjusting a time when the print engine prints on the print medium based on the determined difference. Further characteristics and features of the present invention are disclosed herein.

11 Claims, 5 Drawing Sheets

APPARATUS AND METHOD OF COMPENSATING FOR PRINT ENGINE AND ENCODER EXPANSION OR CONTRACTION IN A PRINTING DEVICE

CROSS REFERENCE TO RELATED APPLICATION(S)

This is a continuation of application Ser. No. 09/690,689 now U.S. Pat. No. 6,318,839 filed on Oct. 16, 2000 which is hereby incorporated by reference herein.

BACKGROUND AND SUMMARY

The present invention relates to printing devices. More particularly, the present invention relates to an apparatus and method of compensating for print engine expansion or contraction in a printing device.

Printing devices, such as inkjet printers and laser printers, include print engines that use printing composition (e.g., ink or toner) to print images (text, graphics, etc.) onto a print medium in a printzone of the printing device. Inkjet printer print engines may use print cartridges, also known as "pens", which shoot drops of printing composition, referred to generally herein as "ink", onto a print medium such as paper, transparency or cloth. Each pen typically has a different color ink, such as cyan, magenta, yellow or black, and a printhead that includes a plurality of nozzles. Each nozzle has an orifice through which the drops are ejected. To print an image, each printhead is propelled back and forth across a print medium along a scan axis by, for example, a carriage of the print engine while ejecting drops of ink in a desired pattern as the printhead moves. Each pen is disposed in the carriage a distance apart from any other pens. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the print medium, the ink is expelled in a pattern onto the print medium to form a desired image (e.g., picture, chart or text).

In order to help optimize the appearance of printed images, the individual pens are aligned so that the different colored drops of ink ejected therefrom are placed onto a print medium at the desired location. Such pen-to-pen alignment is typically done through the use of a test pattern that is printed and then measured by a sensor or judged by a user.

Print engines of printing devices, such as inkjet printers, often depend on a linear displacement optical encoder to trigger the firing of the pens as well as to provide feedback for position and velocity of the carriage holding the pens. The optical encoder may be made from things such as photo imaged MYLAR brand film. The optical encoder works with a light source and a light detector, both of which are typically mounted on the carriage. The light source directs light through the encoder which is received by the light detector and converted into an electrical signal which is used by electronics of the printing device to control firing of the pens, as well as carriage position and velocity. Markings or indicia on the encoder periodically block this light from the light detector in a predetermined manner which results in a corresponding change in the electrical signal from the detector.

During operation of the printing device, ambient temperature and humidity may change. Such changes may cause the encoder and one or more elements of the print engine, such as the carriage, to expand or contract depending on whether temperature and humidity are increasing or decreasing. As the carriage expands or contracts in the scan axis direction with changes in ambient temperature or humidity, the pen-to-pen distance will change. If the encoder expands or contracts at the same rate as the carriage, the effective resolution of the printer will shift, but the pens will stay in alignment. If the carriage and encoder expand or contract at different rates, however, the pens will no longer be aligned and output print quality of the printing device will likely be degraded.

An apparatus and method that solved the above-described problems associated with print engine and encoder expansion or contraction would be a welcome improvement. Accordingly, the present invention is directed to compensating for print engine and encoder expansion or contraction to help maintain alignment of the print elements of the print engine.

An embodiment of an apparatus in accordance with the present invention for use in a printing device, the printing device including a print engine and an encoder that indicates where the print engine should print on a print medium, includes a first target on the encoder and a second target on the encoder. The apparatus also includes a first sensor configured to output a first signal upon detection of the first target and a second sensor configured to output a second signal upon detection of the second target. The apparatus additionally includes a computing device coupled to the first sensor to receive the first signal, the second sensor to receive the second signal, and the print engine. The computing device is configured to determine a difference between receipt of the first signal and the second signal, and the computing device is further configured to adjust when the print engine prints on the print medium based on this difference.

The above-described embodiment of an apparatus in accordance with the present invention may be modified and include at least the following characteristics, as described below. The first target and the second target may be formed through the encoder. The encoder may be a substantially rectangular strip.

The first sensor and the second sensor may be positioned on the print engine. The print engine may include a carriage and at least one inkjet printhead disposed on the carriage. In such cases, the first sensor and the second sensor may be positioned on the carriage.

An alternative embodiment of an apparatus in accordance with the present invention for use in a printing device, the printing device including a print engine and an encoder that indicates where the print engine should print on a print medium, includes structure for measuring a difference between an amount of expansion of the print engine during printing and an amount of expansion of the encoder. The apparatus additionally includes structure for adjusting a time when the print engine prints on the print medium based on the determined difference.

An embodiment of a method in accordance with the present invention for use in a printing device, the printing device including a print engine and an encoder that indicates where the print engine should print on a print medium, includes measuring a difference between an amount of expansion of the print engine during printing and an amount of expansion of the encoder. The method additionally includes adjusting a time when the print engine prints on the print medium based on the determined difference.

The above-described embodiment of a method in accordance with the present invention may be modified and include the following characteristics, as described below. The method may include aligning image data printed on the print medium by the print engine. The print engine may include a carriage and at least one inkjet printhead disposed on the carriage.

The foregoing summary is not intended by the inventor to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Additionally, it should be noted that the use of the word substantially in this document is used to account for things such as engineering and manufacturing tolerances, as well as variations not affecting performance of the present invention. Other objects, advantages, and novel features of the present invention will become apparent from the following detailed description of the invention when considered in conjunction with the accompanying drawings.

DETAILED DESCRIPTION OF THE DRAWINGS

Figure 1:
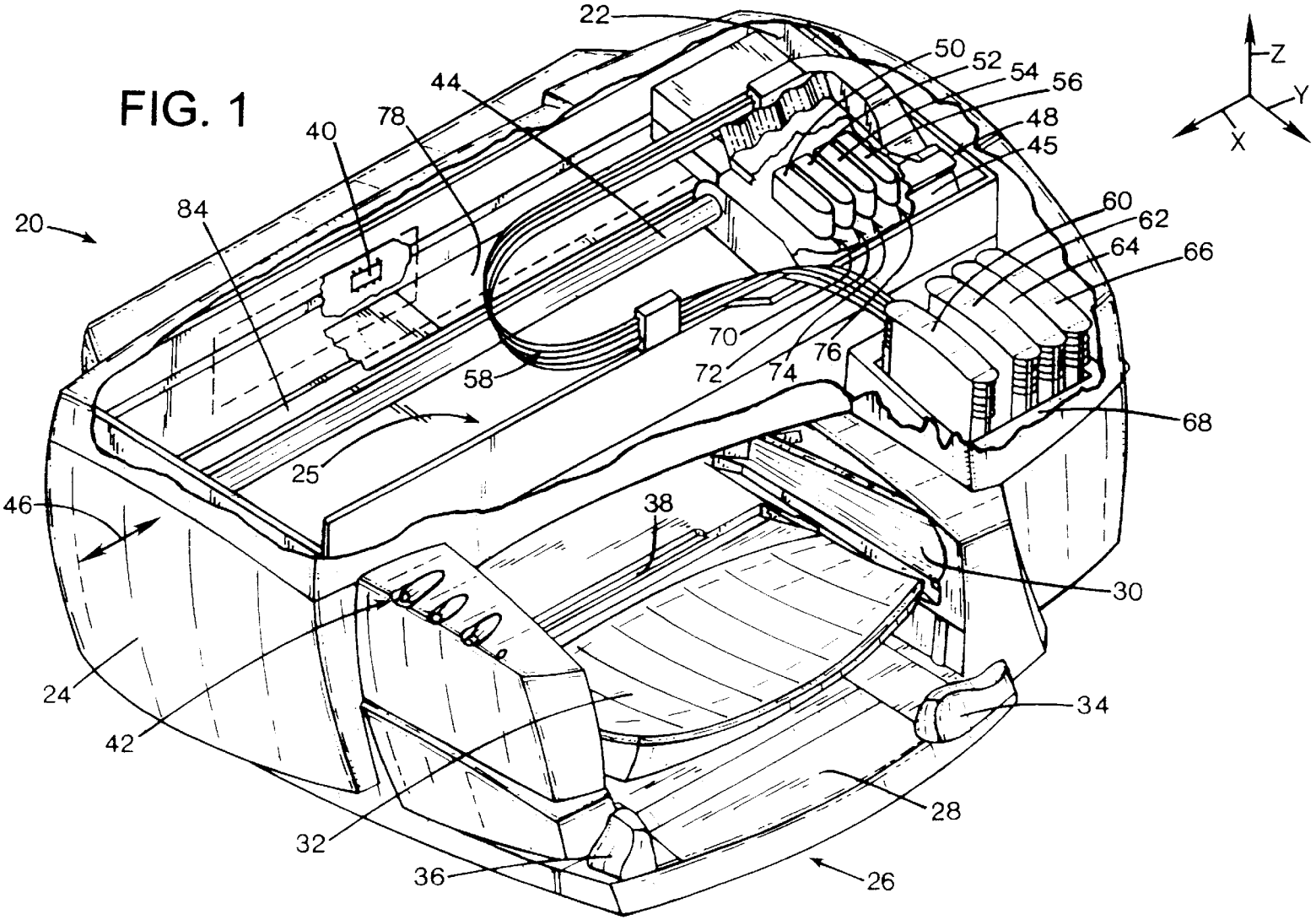
FIG. 1 is a view of a printing device that includes an embodiment of the present invention.

FIG. 1 illustrates an embodiment of an inkjet printing device 20, here shown as an "off-axis" inkjet printer, in accordance with the present invention, which may be used for printing business reports, correspondence, desktop publishing, and the like, in an industrial, office, home or other environment. A variety of inkjet printing devices are commercially available. For example, some of the printing devices that may embody the present invention include plotters, portable printing units, copiers, cameras, video printers, and facsimile machines, to name a few, as well as various combination devices, such as a combination facsimile and printer. In addition, the present invention may be used in a variety of types of printing devices such as inkjet printers and laser printers. For convenience, the concepts of the present invention are. illustrated in the environment of an inkjet printer 20.

While it is apparent that the printing device components may vary from model to model, the typical inkjet printer 20 includes a frame or chassis 22 surrounded by a housing, casing or enclosure 24, typically made of a plastic material. Sheets of print media are fed through a printzone 25 by a media handling system 26. The print media may be any type of suitable material, such as paper, card-stock, transparencies, photographic paper, fabric, mylar, and the like, but for convenience, the illustrated embodiment is described using paper as the print medium. Media handling system 26 has an input supply feed tray 28 for storing sheets of print media before printing. A series of conventional print media drive rollers driven by a stepper motor and drive gear assembly (both of which are not shown) may be used to move the print media from the feed tray 28, through the printzone 25, and, after printing, onto a pair of extended output drying wing members 30, only one of which is shown in a retracted or rest position in FIG. 1. Wings 30 momentarily hold a newly printed sheet of print media above any previously printed sheets still drying in an output tray portion 32, then wings 30 retract to the sides to drop the newly printed sheet into output tray 32. Media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

Printing device 20 also has a computing device 40, illustrated schematically as a microprocessor, that receives instructions from a host device, typically a computer, such as a personal computer (not shown). Many of the functions of computing device 40 may be performed by the host computer, by electronics on board the printer, or by interactions between the host computer and the electronics. As used herein, the term "computing device 40" encompasses these functions, whether performed by the host computer, the printer, an intermediary device between the host computer and printer, or by combined interaction of such elements. Computing device 40 may also operate in response to user inputs provided through a key pad 42 located on the exterior of the casing 24. A monitor (not shown) coupled to the computer host (also not shown) may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by chassis 22 to slidably support a print engine, illustrated as an off-axis inkjet pen carriage system 45, for travel back and forth across printzone 25 along a scanning axis 46. As can be seen in FIG. 1, scanning axis 46 is substantially parallel to the X-axis of the XYZ coordinate system shown in FIG. 1. Carriage 45 is also propelled along guide rod 44 into a servicing region, as indicated generally by arrow 48, located within the interior of housing 24. A conventional carriage drive gear and dc (direct current) motor assembly (both of which are not shown in FIG. 1) may be coupled to carriage 45, with the dc motor operating in response to control signals received from computing device 40 to incrementally advance carriage 45 along guide rod 44 in response to movement of the dc motor.

In printzone 25, the print medium receives ink from an inkjet cartridge, such as a black color ink cartridge 50 and three monochrome color ink cartridges 52, 54 and 56. Cartridges 50, 52, 54, and 56 are also often called "pens" by those in the art. Pens 50, 52, 54, and 56 each include small reservoirs for storing a supply of ink in what is known as an "off-axis" ink delivery system, which is in contrast to a replaceable ink cartridge system where each pen has a reservoir that carries the entire ink supply as the printhead reciprocates over printzone 25 along the scan axis 46. The replaceable ink cartridge system may be considered as an "on-axis" system, whereas systems which store the main ink supply at a stationary location remote from the printzone scanning axis are called "off-axis" systems. It should be noted that the present invention is operable in both off-axis and on-axis systems.

In the illustrated off-axis printer 20, ink of each color for each printhead is delivered via a conduit or tubing system 58 from a group of main stationary ink reservoirs 60, 62, 64, and 66 to the on-board reservoirs of respective pens 50, 52, 54, and 56. Stationary ink reservoirs 60, 62, 64, and 66 are replaceable ink supplies stored in a receptacle 68 supported by printer chassis 22. Each of pens 50, 52, 54, and 56 has a respective printhead 70, 72, 74, and 76 (see also FIG. 3) which selectively ejects ink to from an image on a print medium in printzone 25.

Printheads 70, 72, 74, and 76 each have an orifice plate with a plurality of nozzles formed therethrough in a manner well known to those skilled in the art. The illustrated printheads 70, 72, 74, and 76 are thermal inkjet printheads, although other types of printheads may be used, such as piezoelectric printheads. Thermal printheads 70, 72, 74, and 76 typically include a plurality of resistors which are associated with the nozzles. Upon energizing a selected resistor, a bubble of gas is formed which ejects a droplet of ink from the nozzle onto a sheet of print media in printzone 25 under the nozzle. The printhead resistors are selectively energized in response to firing command control signals delivered by a multi-conductor strip 78 from the computing device 40 to printhead carriage 45.

To provide carriage positional feedback information to computing device 40, an encoder 84 extends along the length of the printzone 25 and over the service station area 48, with a conventional optical encoder reader (not shown) being mounted on a back surface of carriage 45 to read positional information provided by encoder 84. Encoder 84 may have a variety of different configurations, including the illustrated optical substantially rectangular strip configuration shown. Printing device 20 uses encoder 84 and the optical encoder reader to trigger the firing of printheads 70, 72, 74, and 76, as well as to provide feedback for position and velocity of carriage 45. Encoder 84 may be made from things such as photo imaged MYLAR brand film, and works with a light source and a light detector (both of which are not shown) of the optical encoder reader. The light source directs light through encoder 84 which is received by the light detector and converted into an electrical signal which is used by computing device 40 of printing device 20 to control firing of printheads 70, 72, 74, and 76, as well as carriage 45 position and velocity. Markings or indicia on encoder 84 periodically block this light from the light detector in a predetermined manner which results in a corresponding change in the electrical signal from the detector. The manner of providing positional feedback information via the optical encoder reader may be accomplished in a variety of different ways known to those skilled in the art.

Figure 2:
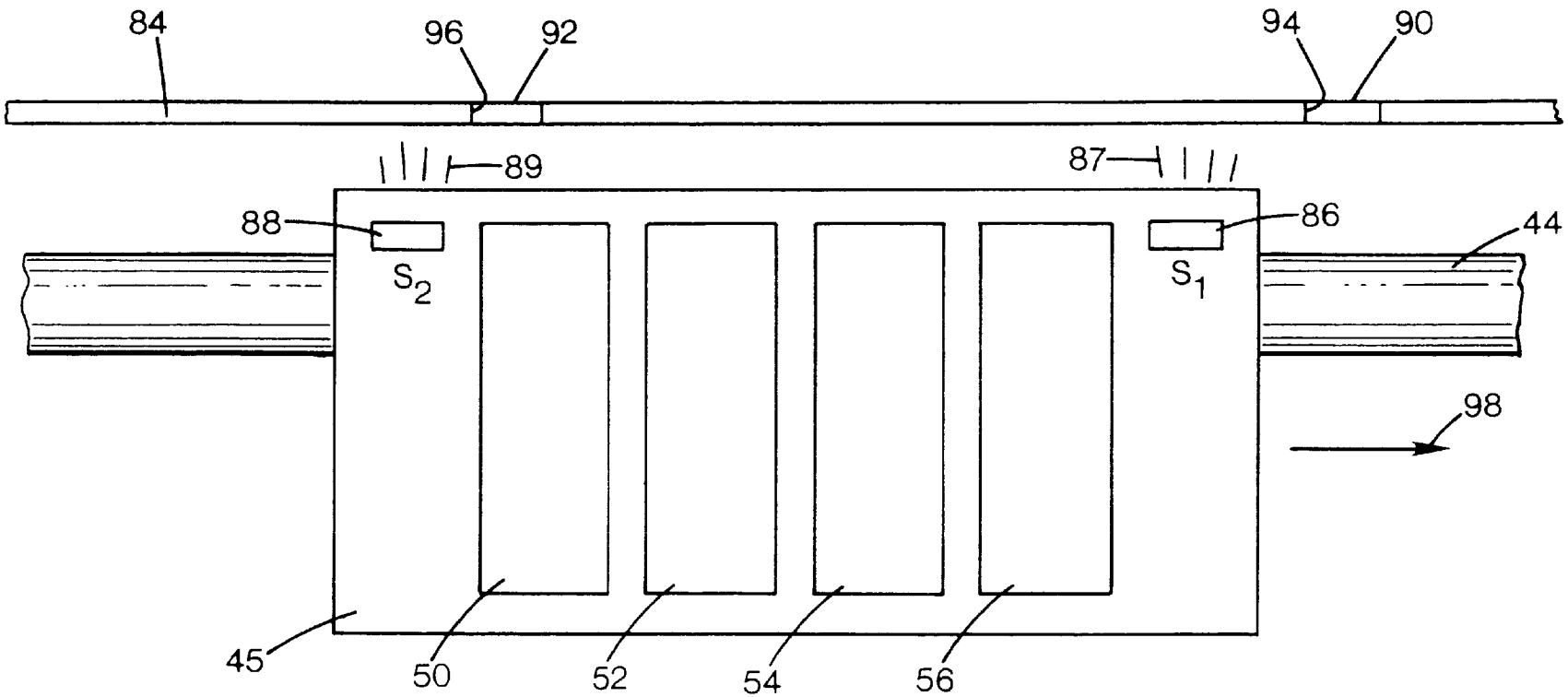
FIG. 2 is a top diagrammatic view of a print engine and an embodiment of the present invention.
Figure 3:
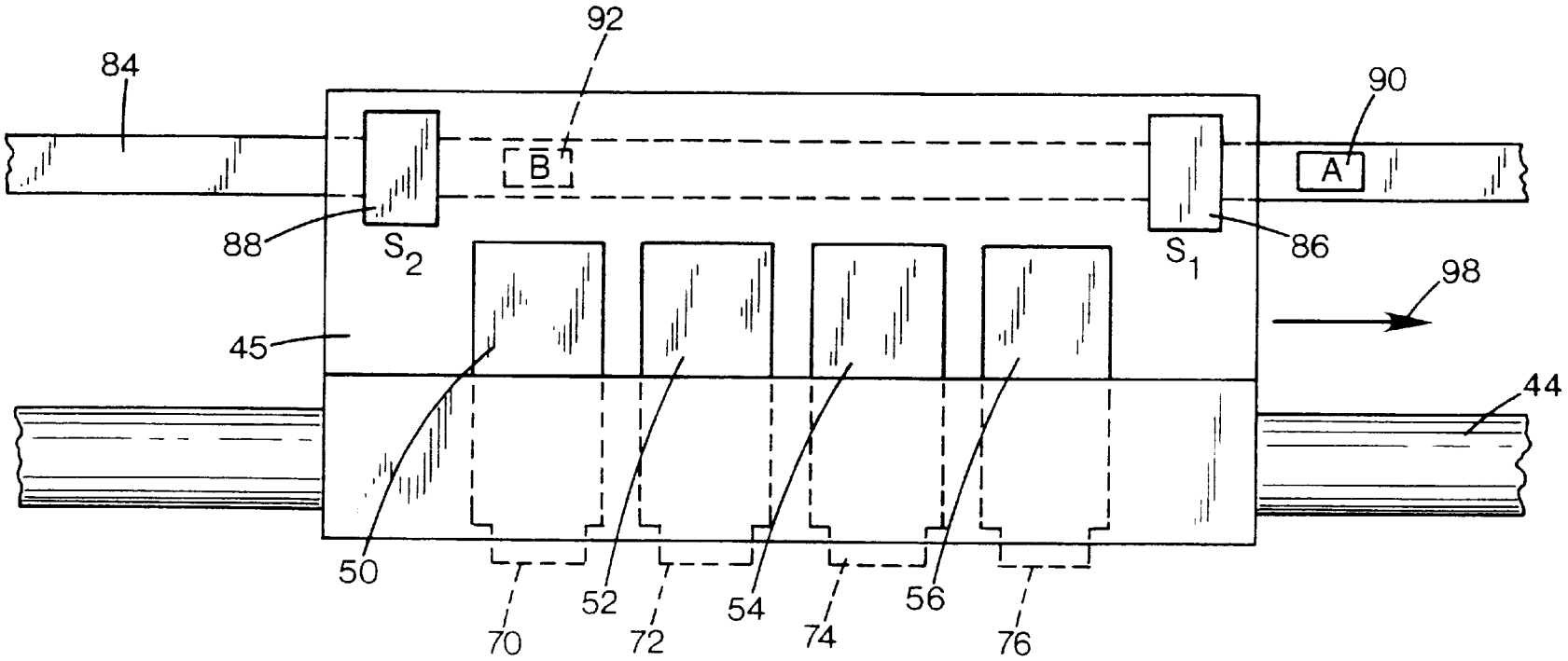
FIG. 3 is a side diagrammatic view of the print engine and embodiment of the present invention shown in FIG. 2.

A top diagrammatic view of print engine 45, illustrated as an off-axis inkjet pen carriage system, and an embodiment of the present invention are shown in FIG. 2. A side diagrammatic view of print engine 45 and embodiment of the present invention are shown in FIG. 3. As can be seen in FIGS. 2 and 3, the present invention includes a first sensor 86 (designated $S_1$) and a second sensor 88 (designated $S_2$). First sensor 86 and second sensor 88 are each coupled to computing device 40 and configured to output respective light signals 87 and 89, as shown. In accordance with the present invention, encoder 84 is configured to include a first target 90 (designated "A" in FIG. 3) and a second target 92 (designated "B" in FIG. 3), spaced apart from first target 90. First and second targets 90 and 92 may be placed on encoder 84 in any of a variety of ways, including by forming apertures 94 and 96 through encoder 84 as shown in FIG. 2. Additionally, first and second targets 90 and 92 may be configured to either transmit (as shown in FIG. 2) or reflect light signals 87 and 89.

In operation in accordance with the present invention, first sensor 86 is configured to output light signal 87 toward encoder 84 and second sensor 88 is configured to output light signal 89 toward encoder 84 as shown in FIG. 2. As carriage 45 moves along guide rod 44 in the direction of arrow 98, first sensor 86 eventually encounters first target 90 and light signal 87 is transmitted through aperture 94. Upon this occurrence, first sensor 86 outputs a first signal 104 (see FIG. 4) to computing device 40 indicating detection of first target 90. Likewise, as carriage 45 moves along guide rod 44 in the direction of arrow 98, second sensor 88 eventually encounters second target 92 and light signal 89 is transmitted through aperture 96. Upon this occurrence, second sensor 88 outputs a second signal 106 (see FIG. 4) to computing device 40 indicating detection of second target 92.

During operation of printing device 20, ambient temperature and humidity may change. Such changes may cause encoder 84 and one or more elements of the print engine, such as carriage 45, to expand or contract depending on whether temperature and humidity are increasing or decreasing. As carriage 45 expands or contracts in the scan axis 46 direction with changes in temperature or humidity, the distance between printheads 70, 72, 74 and 76 of respective pens 50, 52, 54 and 56 will change. If encoder 84 expands or contracts at the same rate as carriage 45, the effective resolution of printing device 20 will shift, but pens 50, 52, 54 and 56 will stay in alignment. If carriage 45 and encoder 84 expand or contract at different rates, however, pens 50, 52, 54 and 56 will no longer be aligned and output print quality of printing device 20 will likely be degraded. The present invention is directed to solving these alignment problems associated with expansion and contraction of the print engine (in the illustrated embodiment carriage 45) and encoder 84 with changes in ambient temperature and humidity.

Figure 4:
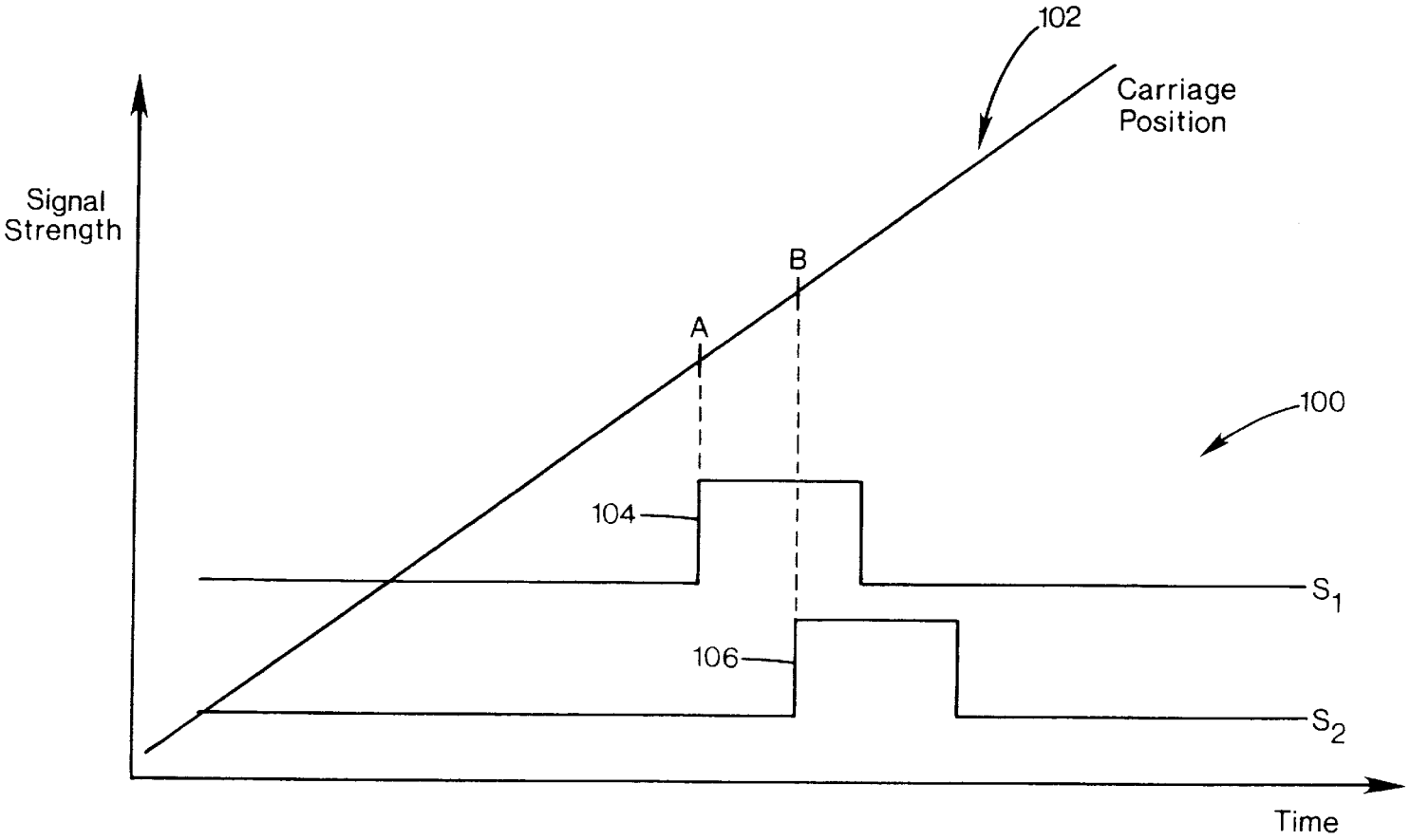
FIG. 4 is a graph of signal strength versus time and a graph of carriage position versus time for the embodiment of the present invention shown in FIGS. 1–3.

A graph 100 of signal strength versus time in accordance with the present invention and a graph 102 of carriage 45 position versus time for the embodiment of the present invention illustrated in FIGS. 1–3 is shown in FIG. 4. As can be seen in FIG. 4, first signal 104 of sensor 86 is shown, as is second signal 106 of sensor 88. As can also be seen in FIG. 4, the position of carriage 45 as it passes first target 90 ("A") and second target 92 ("B") is additionally shown. Depending upon the relative rates of expansion and contraction between carriage 45 and encoder 84, first signal 104 may either lead or lag second signal 106 in graph 100, as discussed more fully below.

As can further be seen in FIG. 4, first signal 104 occurs as first sensor 86 passes first target 90 ("A"), indicating light signal 87 is passing through aperture 94, and second signal 106 later occurs as second sensor 88 passes second target 92 ("B"), indicating light signal 89 is passing through aperture 96. These relative first signal 104 and second signal 106 positions shown in FIG. 4 indicate that carriage 45 has expanded relative to encoder 84, assuming that first signal 104 and second signal 106 were initially substantially aligned.

In accordance with the present invention, computing device 40 is configured to determine the difference between receipt of first signal 104 and second signal 106, and adjust when pens 50, 52, 54 and 56 of the print engine print on the print medium based on this difference. In this manner, the present invention maintains alignment of pens 50, 52, 54 and 56 in spite of relative expansion between encoder 84 and carriage 45 of the print engine of printing device 20.

Although not shown in FIG. 4, it is to be understood that if second signal 106 occurs before first signal 104, such positions indicate that carriage 45 has contracted relative to encoder 84. In accordance with the present invention, computing device 40 is also configured to determine the difference between receipt of first signal 104 and second signal 106 in this case, and adjust when pens 50, 52, 54 and 56 of the print engine print on the print medium based on this difference. In this manner, the present invention maintains alignment of pens 50, 52, 54 and 56 in spite of relative contraction between encoder 84 and carriage 45 of the print engine of printing device 20.

In other instances of operation of printing device 20, no difference may occur between first signal 104 and second signal 106, such that signals 104 and 106 would be substantially aligned in FIG. 4 and the difference between these signals would be substantially zero. In accordance with the present invention, computing device 40 is configured determine this substantially zero difference and not adjust when pens 50, 52, 54 and 56 of the print engine print on the print medium.

Figure 5:
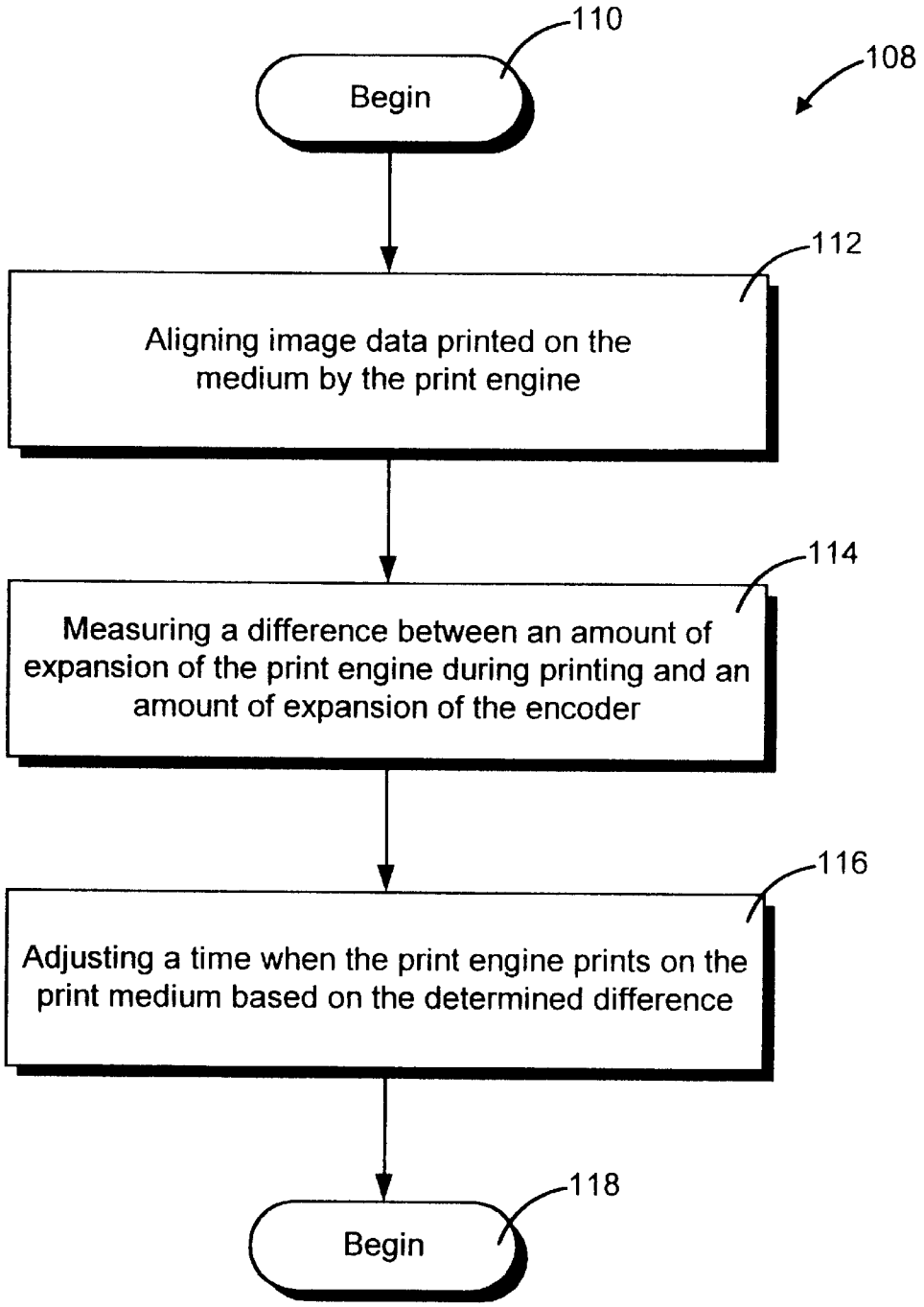
FIG. 5 is an embodiment of a method in accordance with the present invention.

An embodiment of a method 108 in accordance with the present invention is shown in FIG. 5. As can be seen in FIG. 5, method 108 begins 110 by aligning image data printed on the print medium by the print engine 112. In order to help optimize the appearance of printed images, the individual pens 50, 52, 54 and 56 of different colors are aligned so that the different colored drops of ink ejected therefrom by respective printheads 70, 72, 74 and 76 are placed onto a print medium at the desired location. Such pen-to-pen alignment is typically done through the use of a test pattern that is printed and then measured by a sensor or judged by a user.

Next, method 108 measures a difference between an amount of expansion of the print engine 45 during printing and an amount of expansion of the encoder 84, as generally indicated by block 114. Next method 108 adjusts a time when the print engine 45 prints on the print medium based on the determined difference, as generally indicated by block 116. Method 108 then ends, as generally indicated at 118.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiment(s) disclosed. Modifications and variations may well be apparent to those skilled in the art. Similarly, any method elements described may be interchangeable with other method elements in order to achieve the same result.

For example, in alternative embodiments of the present invention, sensors 86 and 88 and targets 90 and 92 may be magnetic. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . . ."

What is claimed is:

1. A method of controlling a printing device that has expandable and contractible components including the steps of aligning a pair of spaced apart targets on one component with a pair of sensors on another component; generating a control signal that represents changes in the relative position of the components and which changes are attributable to expansion or contraction of the expandable and contractible components; and measuring over time a change in the spacing between the targets relative to a change in spacing between the sensors.

2. The method of claim 1 including the step of monitoring both of the changes and periodically updating the control signal.

3. The method of claim 1 wherein one of the components includes a printhead that is controlled by a computing device for ejecting droplets of ink to media, the method including the step of providing the control signal to the computing device for controlling the timing of the droplet section.

4. A method of assembling a printing device that includes a first expandable and contractible component and a second expandable and contractible component, the method comprising the steps of:

locating a pair of spaced apart targets on the first component so that the spacing between those targets changes as the first component contracts and expands;

locating a pair of sensing elements on the second component so that the spacing between the sensing elements changes as the second component contracts and expands; and recording a first position of the targets relative to the sensing elements thereby to permit comparison of the first position with a second position of the targets that represents changes in the first position.

5. The method of claim 4 wherein the step of locating a pair of sensing elements includes the step of providing sensors for detecting the presence of the targets and for generating output signals representing the second position of the targets relative to the sensing elements.

6. The method of claim 4 wherein the step of locating a pair of spaced apart targets includes locating the targets on an encoder element that includes thereon information that can be sensed and correlated to the position of a carriage in a printing device.

7. The method of claim 4 wherein the step of locating a pair of spaced apart sensing elements includes locating the elements on a movable carriage in the printing device.

8. A carriage assembly for a printing device comprising:

a carriage member for supporting a printhead therein;

a first sensor mounted to the carriage for sensing the location of a first target that is mounted to the printing device, the carriage being movable relative to the first target; and a second sensor mounted to the carriage for sensing the location of a second target that is mounted to the printing device, the carriage being movable relative to the second target, wherein the first and second sensors are space apart by a distance that is changeable in response to expansion and contraction of the carriage; and a computing device connected to the sensors and operable for monitoring changes in the distance.

9. The assembly of claim 8 wherein the first and sensors include light emitting elements.

10. The assembly of claim 8 wherein the first and second sensors include magnetic elements.

11. The assembly of claim 8 further comprising an encoder member along which is movable the carriage member, the encoder member carrying the first and second targets.

* * * * *

UNITED STATES PATENT AND TRADEMARK OFFICE

CERTIFICATE OF CORRECTION

PATENT NO. : 6,499,827 B2
DATED : December 31, 2002
INVENTOR(S) : Steven B. Elgee It is certified that error appears in the above-identified patent and that said Letters Patent is hereby corrected as shown below:

Column 8,
Line 13, “section” should read -- ejection --.
Line 51, “space” should read -- spaced --;
Line 56, “sensors” should read -- second sensors --;
Line 61, “is movable the carriage member,” should read -- the carriage member is movable, --.

Signed and Sealed this

Twenty-third Day of September, 2003

JAMES E. ROGAN
*Director of the United States Patent and Trademark Office*